United States Patent [19]

Dubois

[11] B 3,995,907

[45] Dec. 7, 1976

[54] UNDERGROUND EXCAVATING MACHINE HAVING INDEPENDENTLY MOVABLE HALF-FRAMES

[75] Inventor: Michel Dubois, Ittre, Belgium

[73] Assignee: Linden-Alimak AB, Skelleftea, Sweden

[22] Filed: Aug. 21, 1974

[21] Appl. No.: 499,209

[44] Published under the second Trial Voluntary Protest Program on February 24, 1976 as document No. B 499,209.

[30] Foreign Application Priority Data

Aug. 22, 1973 Luxembourg ..... 68283

[52] U.S. Cl. ..... 299/31; 61/45 D; 180/8 C; 238/10 A; 299/64; 299/86

[51] Int. Cl.[2] ..... E21D 9/10

[58] Field of Search ..... 299/31, 32; 305/1; 180/8 R, 8 C, 8 D, 8 E, 7; 105/31; 104/3, 4, 147, 162; 238/10 A; 61/45 D

[56] References Cited

UNITED STATES PATENTS

| | | | |
|---|---|---|---|
| 2,452,632 | 11/1948 | Cameron | 180/8 D |
| 3,106,825 | 10/1963 | Barall et al. | 299/31 X |
| 3,512,597 | 5/1970 | Baron | 180/8 C |
| 3,663,054 | 5/1972 | Dubois | 299/31 |

*Primary Examiner*—Ernest R. Purser

[57] ABSTRACT

The machine includes two half-frames vertically arranged side by side, with two parallel vertical shafts respectively supported by the two half-frames. A separate turret is pivotally supported around each of the shafts, each turret having a cutting head which can rotate around a horizontal axis and which is equipped with tools for excavating. The two half-frames are slidably movable horizontally in relation to one another, with a control member connected between the half-frames for controlling the relative movement, the two half-frames being selectively positionable on the gallery floor by said relative movement, one half-frame being movable while the other half-frame remains fixed in position.

29 Claims, 60 Drawing Figures

UNDERGROUND EXCAVATING MACHINE HAVING INDEPENDENTLY MOVABLE HALF-FRAMES

This invention relates to a machine for excavating underground galleries, and more particularly to a machine for excavating underground galleries in mines. However, it is to be understood that embodiments of the invention can be used for excavating underground tunnels, or other excavating work.

A prior proposed machine for excavating underground galleries comprises a main frame adapted to be anchored to the walls of a gallery by a system of jacks, rods and jaws. Two separate auxiliary frames slide on the main frame, which is intermittently advanced by a main jack. Each auxiliary frame has at the front thereof a vertical shaft around which at least one rotary arm is alternately pivoted by an auxiliary jack. Each arm bears at its end a rotary cutting head bearing one or preferably more working tools for attacking the rock or other underground strata.

The prior proposed machine has disadvantages, since it is of heavy and cumbersome construction due to the use of a main frame and two auxiliary frames.

The tools of the prior art machine are too large, since when the auxiliary frames have advanced by a number of steps, the main frame is disengaged from the wall and advanced in one move by a distance equal to the distance of said number of steps, so that a very long main jack is needed. The prior proposed machine takes up a lot of space and is not very practical if the direction of the gallery being excavated suddenly changes, since when the machine must pivot on itself, for instance to start a transverse gallery, it pivots around one of the vertical shafts.

It is an object of the invention to provide a machine for excavating underground galleries in which the above described disadvantages of the prior proposed machine are reduced or obviated.

According to this invention there is provided a machine for excavating an underground gallery, comprising two half-frames which can be displaced in the gallery and which support two parallel vertical shafts around each of which a turret pivots having a cutting head which can rotate around a horizontal axis and which is equipped with tools for excavating, the two half-frames being slidable in relation to one another by a control member, the two half-frames being selectively positionable on the gallery floor, one half-frame being displaceable while the other half frame remains in position.

Conveniently the machine may also comprise an assembly of pivotal levers pivotally connected to the half-frames and distributed on each side of each half frame, each pivot having a jack acting on jaws and cooperating with anchoring rails.

Advantageously the anchoring rails may be secured to anchoring rods, the anchoring rods being set in the floor, so that the half frames are selectively anchorable on the gallery floor.

Two rows of anchoring rods may be provided, one row of rods being set in the floor on either side of the machine.

Advantageously, a pivotal lever of one half-frame may be disposed adjacent the side of the other half-frame which is remote from the said one half frame, said pivotal lever being suspended from a beam attached to the first half-frame and crossing the second half-frame without contact therewith, so as to cooperate with the same anchoring rail as pivotal levers associated with the second half-frame. Said pivotal levers may each comprise a rod having a lifting jack, and the rod of each pivotal lever may rest on one of said rails extending along the floor during the lifting of the frame or half-frame. Furthermore the bottom of the rod of each pivotal lever may have jaws enclosing a flange of said rail on which it rests, so as to act selectively as means for lifting the frame by the pressure being exerted downwards on to the flange of the rail by pivotal lever rod and as means for anchoring the frame by the pivotal lever rod pulling upwards to engage the jaws with the flange, the rail being anchored to the floor.

The rod of each pivotal lever may rest on a rail mounted on an auxiliary support which bears against the floor without being anchored thereto, the bottom of the rod having jaws for bearing against and gripping a flange of the rail.

According to another aspect of this invention there is provided a machine for excavating an underground gallery, comprising a frame which can be displaced in the gallery, the frame having pivotal levers by which it can first be disengaged from the floor and lifted, and then displaced in the gallery by the simultaneous inclination of the pivotal levers and finally replaced on the floor in a fresh position.

According to yet another aspect of this invention, there is provided a machine for excavating an underground gallery, comprising a frame structure consisting essentially of two half-frames which can be displaced in the gallery and bearing two parallel vertical shafts, around each of which a turret pivots having a cutting head which can rotate around a horizontal axis and which is equipped with tools for excavating, each half-frame having pivotal levers by which it can first be disengaged from the floor and lifted, and then displaced in the gallery by the simultaneous inclination of the pivotal levers and finally replaced on the floor in a fresh position.

According to even another aspect of this invention there is provided a machine for excavating an underground gallery, said machine comprising a frame which can be displaced in the gallery, the frame having pivotal levers, pivotal in two directions, which are interconnected at the bottom by two longitudinal sleepers which can rest on the floor and by means of which the frame can first be disengaged from the floor and lifted, then displaced in the gallery by the simultaneous inclination of the pivotal levers, and finally replaced on the floor in a fresh position. The machine may have such a weight that frictional forces between the sleepers and the floor can withstand forces produced by the excavating process.

According to a further aspect of this invention there is provided a machine for excavating an underground gallery, comprising two half-frames which can be displaced in the gallery and bear two parallel vertical shafts around each of which a turret pivots having a cutting head which can rotate around a horizontal axis and which is equipped with tools for excavating, each half-frame having pivotal levers which are pivotal in two directions and which are interconnected at the bottom by two longitudinal sleepers which can rest on the floor and by means of which the half-frame can first be disengaged from the floor and lifted, then displaced in the gallery by the simultaneous inclination of the pivotal levers, and finally replaced on the floor in a fresh position.

Conveniently the longitudinal sleepers may be rigidly connected by a central cross-piece whose centre is formed with a transverse groove or the like parallel with the sleepers and receiving a lever which is pivotally connected to the frame or half frame and in which a deflecting jack, which is also pivoted to the said frame or to a half-frame, can rotate around the pivotal connection.

In one embodiment of the invention the bottom of the frame or half-frame is formed with a groove perpendicular to the transverse groove, and a slide sliding in the first-mentioned groove bears the said pivotal connection between the frame and the lever, and advantageously said pivotal connection between the frame and the lever can be displaced by a jack acting on the slide.

According to yet a further aspect of this invention there is provided a machine for excavating an underground gallery, comprising a frame which can be displaced in the gallery, there being two pivotal levers, pivotal in two directions, on either side of the frame which cooperate with a respective corresponding sleeper to form an articulated parallelogram in which the sleeper forms the base and the two pivotal levers form inclined sides, a control jack disposed substantially along a diagonal of the parallelogram controlling the deformation thereof.

According to even a further aspect of this invention there is provided a machine for excavating an underground gallery, comprising two half-frames which can be displaced in the gallery and which bear two parallel vertical shafts around each of which a turret pivots having a cutting head which can rotate around a horizontal axis and is equipped with tools for excavating, there being two pivotal levers pivotal in two directions on either side of the half-frame which cooperate with a respective sleeper to form an articulated parallelogram in which the sleeper forms the base and the two pivotal levers form inclined sides, a control jack disposed substantially along a diagonal of the parallelogram controlling the deformation thereof.

According to yet a further aspect of this invention there is provided a machine for excavating an underground gallery, comprising two half-frames which can be displaced in the gallery and which bear two parallel vertical shafts around each of which a turret pivots having a cutting head rotating around a horizontal shaft and having tools for excavating, there being two pivotal levers pivotal in two directions on either side of the frame which cooperate with respective sleepers to form an articulated parallelogram in which the sleeper forms the base and the two pivotal levers the inclined sides, a transverse or longitudinal jack operating transversely or longitudinally bearing against the half-frame and the sleeper to advance the latter transversely or longitudinally.

Conveniently the pivotal levers may have a lifting jack adapted to lift the sleepers and frames or half frames alternately.

Advantageously means may be provided for guiding the half frames relative to each other, said guiding means comprising, at least one longitudinal rail along which two slides connected to the other half-frames slide. The half-frames may be pivotally connected to one another and angularly adjustable, and in particular the two half-frames may be pivotally connected by a universal joint pivot.

Conveniently the universal joint pivot may slide vertically in relation to one of the two half-frames. The two half-frames may be angularly adjustable by the action of a transversely pivoting jack, and the two half-frames may pivot individually around the vertical pivot of the universal joint.

Suitably there may be at least one semi-annular collecting tank for collecting cutting spoil, the collecting tank, being swept by a scraper which repels the collected spoil over an inclined ramp terminating at a central evacuating conveyor, and the outer end of the collecting tank may have a fixed semi-cylindrical tumbler which moves the cutting spoil above the scraper.

In one embodiment of the invention the pivotal levers may be interconnected by two rods rigidly connected to one another by a central cross-member which a jack pivotally connected to the frame or half frame can displace on either side of a central position.

In utilising a machine in accordance with the invention having two half frames whilst one half frame is advancing the cutting head of the other stationary frame may be excavating, cutting rock forming a wall of the gallery, and thus the gallery may be formed more quickly than with prior proposed machines.

In order that the invention may be more readily understood and so that further features thereof may be appreciated the invention will now be described by way of example with reference to the accompanying drawings in which.

In the drawings like references denote like parts.

Figure 1:
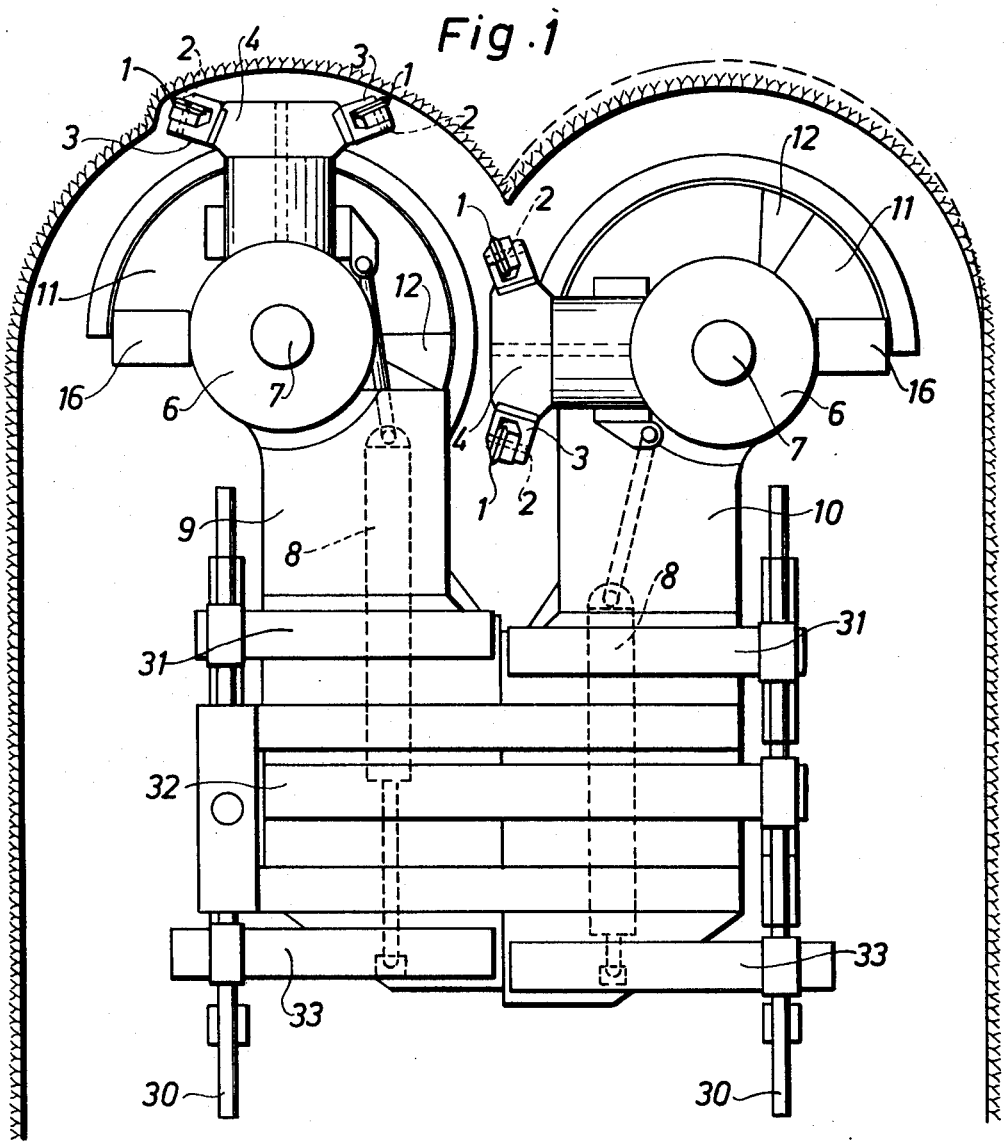
FIG. 1 is a plan view of a first embodiment of a machine in accordance with the invention.

The machine illustrated in FIG. 1 is suitable for excavating underground mine galleries or road or railway tunnels, or other underground galleries or passages, all herein termed "galleries" for the sake of brevity.

In the embodiment illustrated two series of rotary excavating tools 1 act selectively on the two vertical halves of the cutting front, i.e. the portion of a gallery which is being excavated.

Each rotary tool 1 is mounted on a small shaft 2 rotating in bearings disposed on a yoke 3. The yokes 3 are regularly distributed over a rotary cutting head 4.

Figure 2:
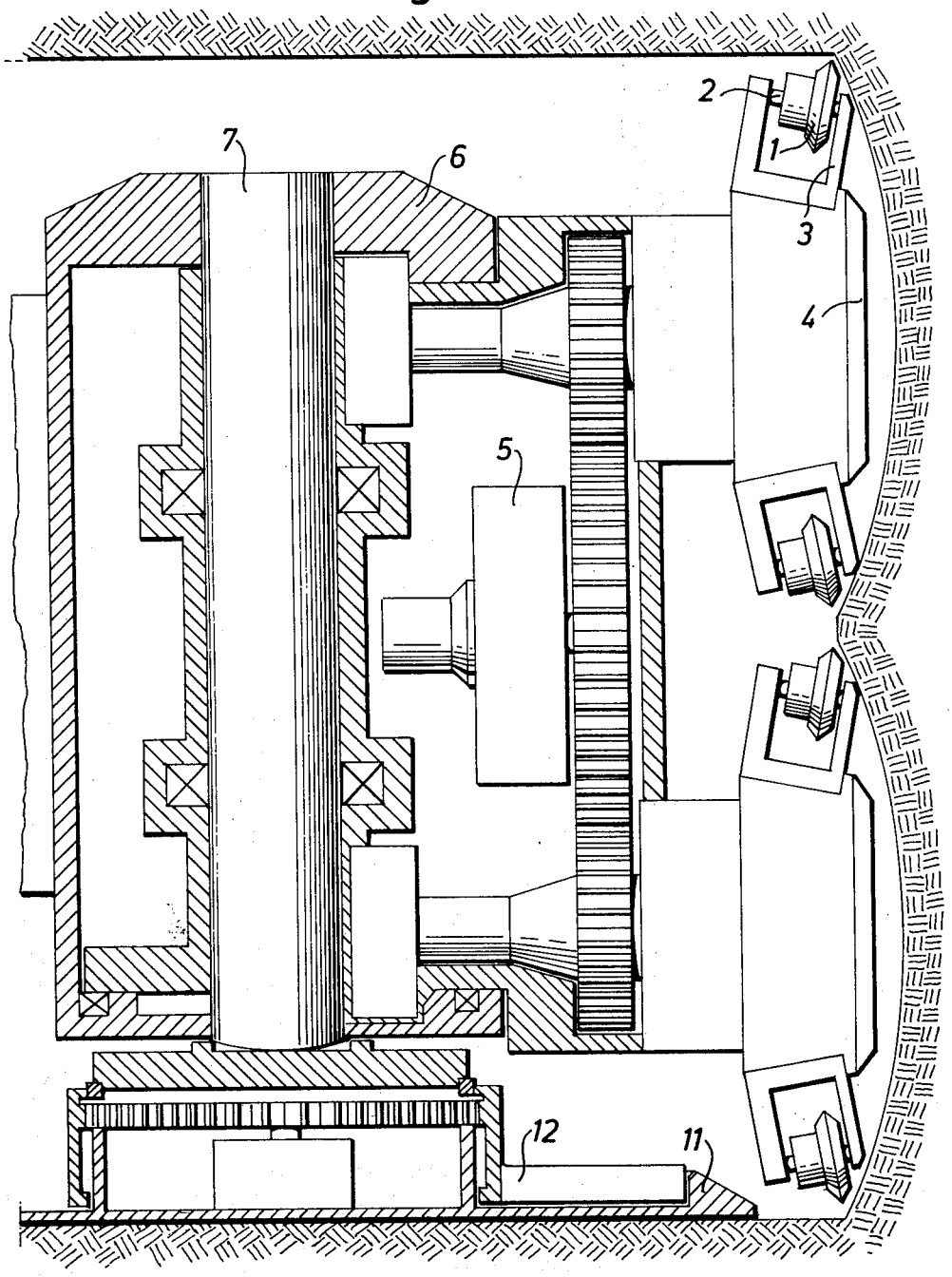
FIG. 2 is a vertical longitudinal section through one of the vertical shafts with rotary arms and cutting heads of the machine illustrated in FIG. 1.

Referring to FIG. 2, each rotary cutting head 4 is rotated around its horizontal axis by drive means 5. Each cutting head 4, connected to a turret 6, rotates horizontally together therewith around a large vertical shaft 7. The cutting head 1 and the turret 6 are given a semi-circular reciprocating movement around the vertical shaft 7 by a pneumatic jack 8 (FIG. 1). The left-hand vertical shaft 7 is carried by a left-hand half-frame 9, the right-hand vertical shaft 7 being carried by a right-hand half-frame 10.

Figure 3:
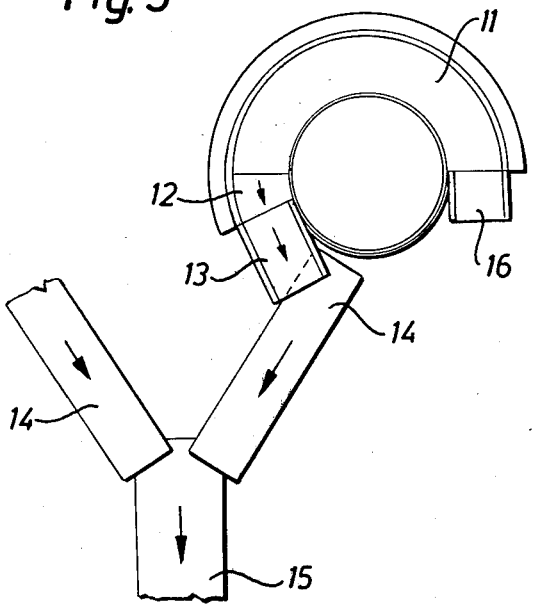
FIG. 3 is a plan view of the device for collecting and conveying the spoil in the machine illustrated in FIG. 1.

Referring to FIG. 3 two semi-annular collecting tanks 11 are disposed at the base of the two vertical shafts 7 to collect the spoil. The two collecting tanks are swept by scrapers 12 which move the spoil collected over inclined ramps 13. Each inclined ramp 13 is disposed at the inner end of the collecting tank 11 and terminates at the entry to a side branch 14 of a system of evacuating conveyors, the system having a Y-shape, the main branch 15 of the system extending along the axis of the gallery between the two half-frames 9, 10. The outer end of each collecting tank 11 has a fixed semi-cylindrical tumbler 16 which moves the cutting spoil above the scraper 12.

Figure 4:
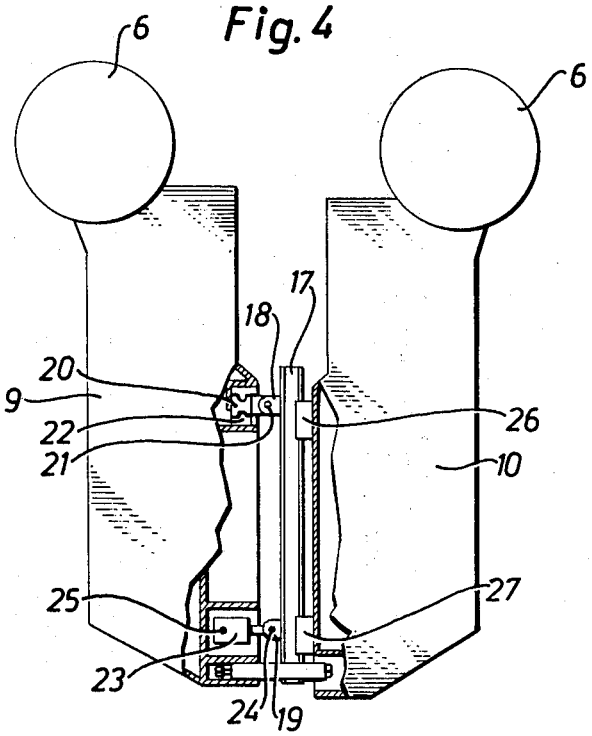
FIG. 4 is a partially sectioned plan view of two half-frames of the machine illustrated in FIG. 1 with their turrets and mutual guiding and pivoting means.
Figure 5:
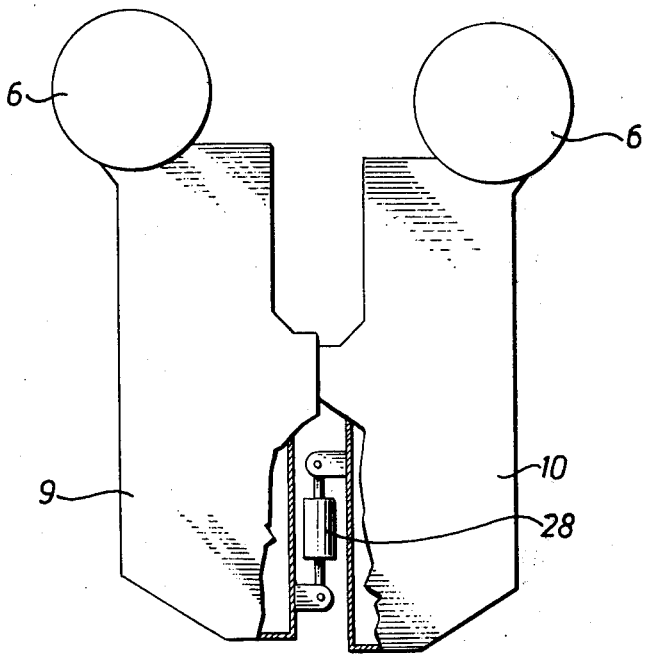
FIG. 5 shows the two half-frames illustrated in FIG. 4 with an advancing jacket.

Referring to FIG. 4 the two half-frames 9, 10 are arranged as follows: the left-hand half-frame 9 supports an inner longitudinal rail 17 which is connected to the side of the right-hand half-frame 10. The rail 17 bears two series of fins 18, 19 directed towards the half-frame 9. The rail 17 is connected via the fins 18 and pivot 21 to a universal joint 20. The universal joint 20 is mounted in a suitable vertical slide 22 of the half-frame 9. The rail 17 is connected via the other fins 19 and by a pivot 24 to a transverse jack 23. The transverse jack 23 can pivot horizontally around another pivot 25 mounted between two fins (not shown) attached to the half-frame 9. The rail 17 can slide longitudinally with reference to half frame 10, in two short slide channels 26, 27, aligned in the same axis and unitary with the right-hand half-frame 10, by a traversing jack 28 (FIG. 5).

Figure 6:
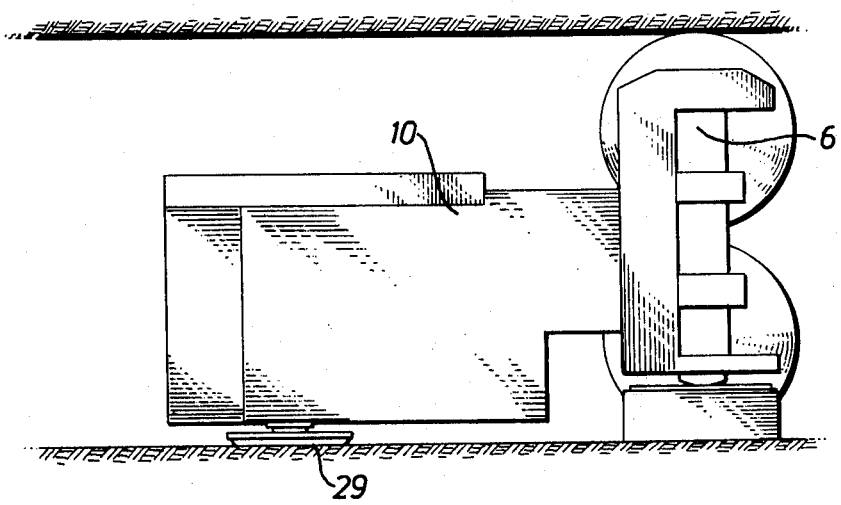
FIG. 6 is a Side view of the embodiment of the machine illustrated in FIG. 1 showing a modification in the vertical inclination of one half-frame in relation to the other.

Thus interconnected, the two half-frames 9, 10 can advance in relation to one another along the axis of the gallery, and also along an axis inclined in relation thereto. To this end the two half-frames 9, 10 can be inclined, on the one hand, horizontally in relation to one another, by their connection around the vertical pivot 21 of the universal joint, due to the action of the transverse jack 23; and, on the other hand, can be inclined vertically, due to the sliding of the universal joint 20 in its slide 22 of the half-frame 9 and the action of the vertical supporting jack 29 of the half-frames 9, 10, the supporting jacks 29 being disposed below and behind the half-frames 9, 10 (FIG. 6).

In this embodiment, the two half-frames 9, 10 are anchored individually and independently of one another to two outer anchoring rails 30 (FIG. 1).

Figure 7:
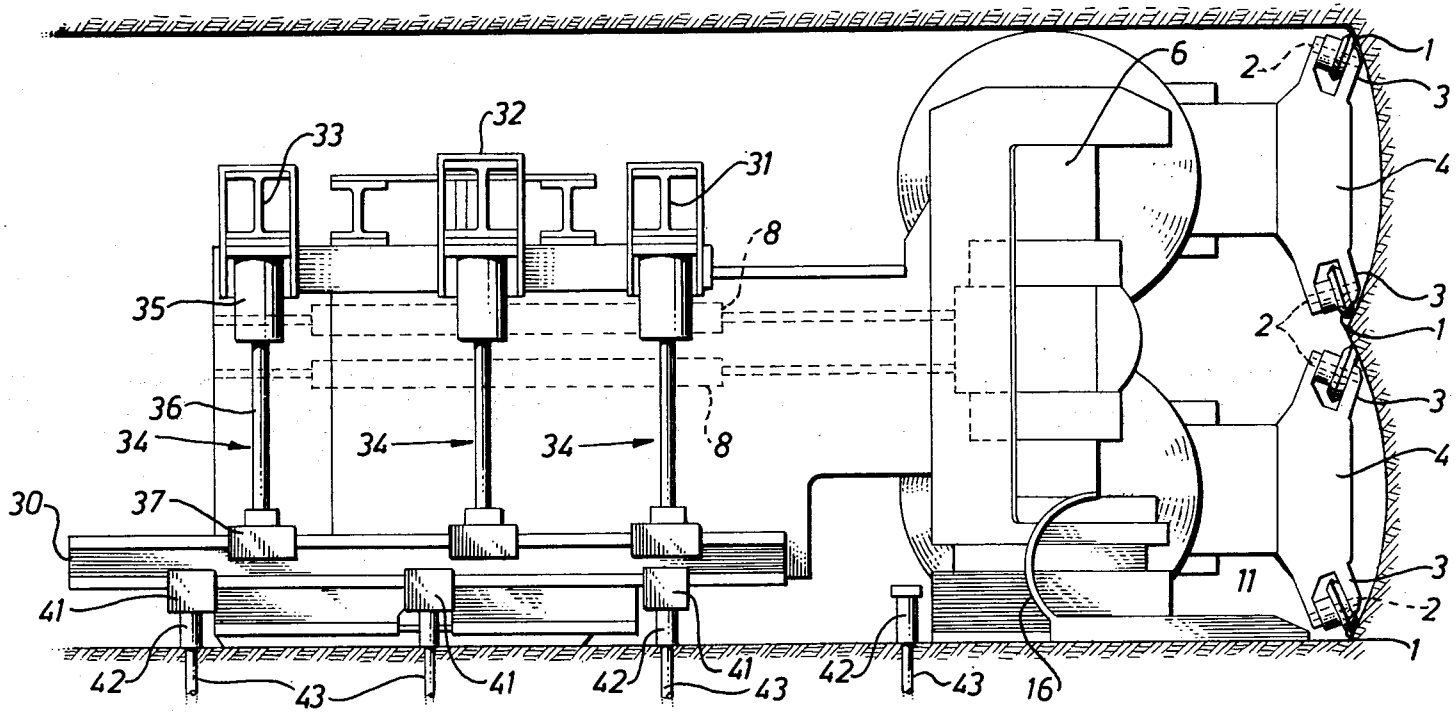
FIG. 7 is a side elevational view of the machine illustrated in FIG. 1.
Figure 10:
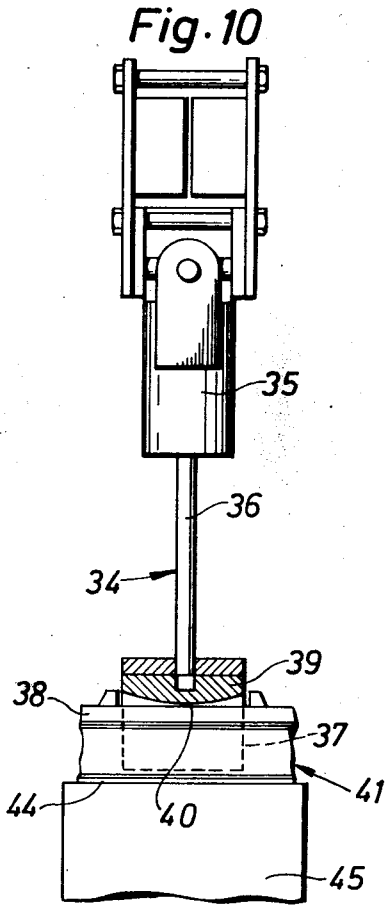
FIG. 10 is a side elevational view of the anchoring means illustrated in FIG. 8.
Figure 8:
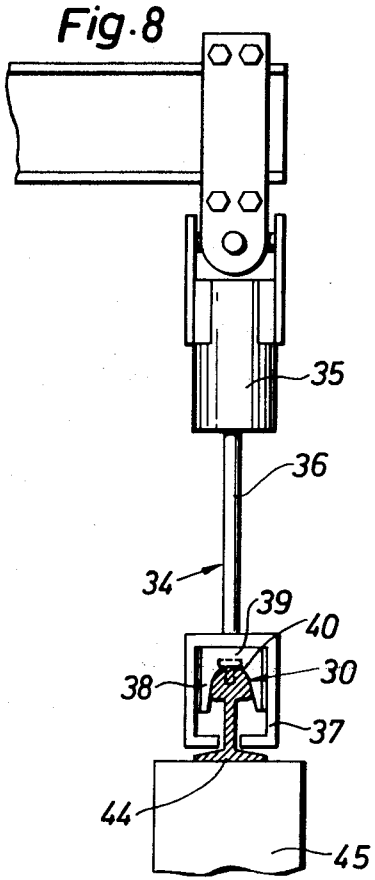
FIG. 8 is a front elevational view of the means for anchoring the machine illustrated in FIG. 1 in relation to anchoring rails connected to the floor.
Figure 9:
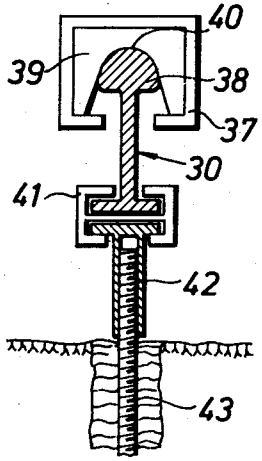
FIG. 9 is a view to an enlarged scale of the anchoring rail and jaws of the rocking lever of the machine illustrated in FIG. 1.

The left-hand half-frame 9 is anchored by three beams 31–33 attached, for instance by welding, to the left-hand half-frame and projecting laterally beyond the edge of the left-hand frame. The central beam 32 straddles the right-hand half-frame 10 without touching it. The outer ends of the beams 31–33 have pivotal levers 34 (FIG. 7) formed by anchoring jacks 35 articulated to the corresponding beam, pivotal lever rods 36 and bearing jaws 39 (FIGS. 8–10) and gripping jaws 37. The pivotal connections of the pivotal lever 34 allows pivotal movement in two directions, i.e. in a longitudinal axis and in a transverse axis. Anchoring is performed by the anchoring jacks 35 urging the gripping jaws 37 upwardly so that the jaws are applied to the inner faces of flanges 38 of the anchoring rails 30. It can be seen that the pivotal levers are located on each side of each of the half frames, one lever being suspended from the beam that crosses the other half frame.

To advance, deflect or pivot the half-frames 9, 10, the lower ends of the bearing jaws 39 of the rods 36 of the pivotal levers 34 cooperate with the rails 30. The flange 38 of the rail 30 has a rounded shape exactly fitting the hollow 40 of the bearing jaw 39. During these operations the pivotal levers 33 act like crutches.

In the advancing operation the rail 30 is mounted via attachments 41 on sleeves 42 screwed to anchoring rods 43 attached to the floor while during the pivoting operation the rail 30 is attached via its lower sleeper 44 to a support 45 resting on the floor.

The machine as hereinbefore described in detail can perform three operations: linear advance, deflection and pivoting. Furthermore the half frames 9 and 10 may be pivoted to lie in different planes.

The advancing movement of one half-frame, for instance, the half-frame 10, is clearly illustrated by FIGS. 11 to 15.

Figure 11:
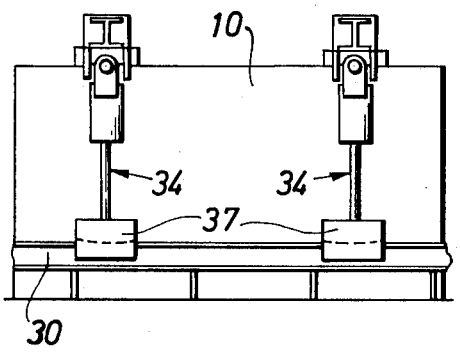
FIGS. 11 to 16 illustrate diagrammatically the successive phases of selective positioning of the half-frames of the machine illustrated in FIG. 1 during a longitudinal advancing operation.

FIG. 11 shows a starting position, in which the two half-frames 9, 10 are resting on the floor and the pivotal levers 34 are resting on the anchoring rails 30.

Figure 12:
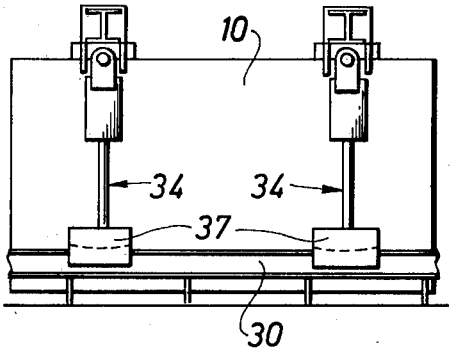

FIG. 12 shows the bearing jaws 39 engaging the rail 30 and the half-frame 10 lifted by anchoring jacks 35.

Figure 13:
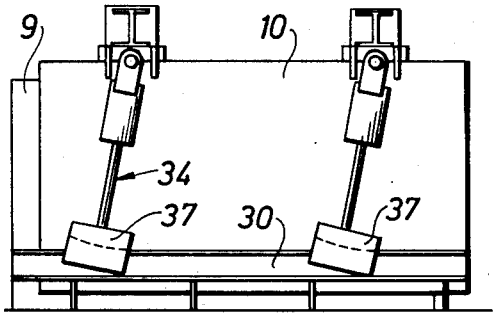

FIG. 13 shows the half-frame 10 urged forwardly by operation of the longitudinal jack 28 to urge half frame 10 forward relative to half frame 9, the pivotal levers supporting half frame 10 pivoting like crutches.

Figure 14:
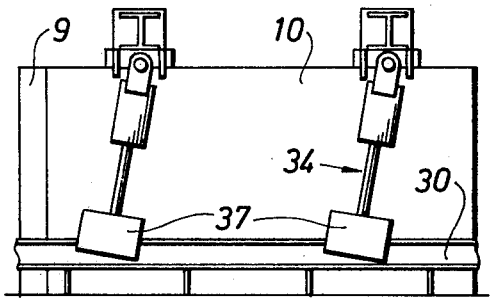

FIG. 14 shows how the half-frame 10 has descended again and is resting on the floor.

Figure 15:
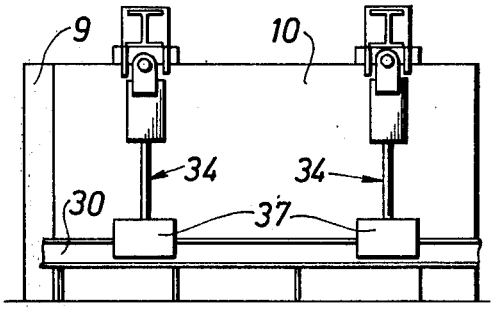

FIG. 15 shows the anchoring jacks slightly lifting the pivotal levers 34, thus releasing the jaws 37, 39 from the rail and permitting the levers to pivot under the force of gravity to a vertical position.

Figure 16:
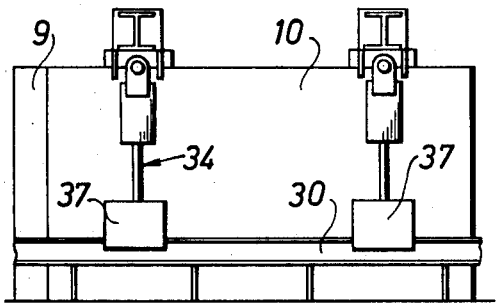

FIG. 16 shows the anchoring jacks again anchoring the half-frame 10 by causing the jaws 37, to engage with the rail 30.

The half-frame 9 can then perform an advance of one step, in a similar manner.

Deflection or the progressive changing of direction is clearly illustrated in FIGS. 17 to 24.

Figure 17:
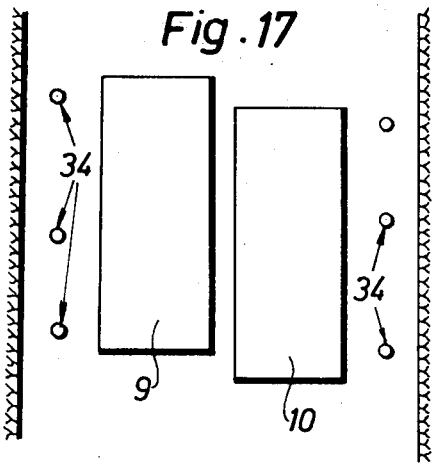
FIGS. 17, 18 and 21 to 24 illustrate diagrammatically the successive phases of selective modification of the orientations of the half-frames during a progressive change in orientation of the machine illustrated in FIG. 1, combined with the stepped advancing operation.

FIG. 17 shows the two half-frames 9, 10 in the anchored position and parallel to start with.

Figure 18:
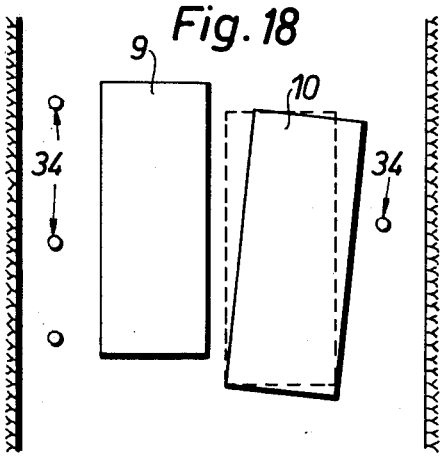

FIG. 18 shows the right-hand half-frame 10 released and lifted and turned towards the right, together with rail 17 which is secured thereto, by action of jack 23 moving frame 10 relative to frame 9.

Figure 21:
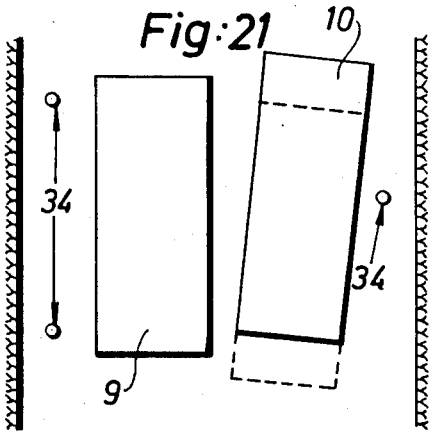

FIG. 21 shows half frame 10 subsequently advanced by one step and again placed on the floor.

Figure 19:
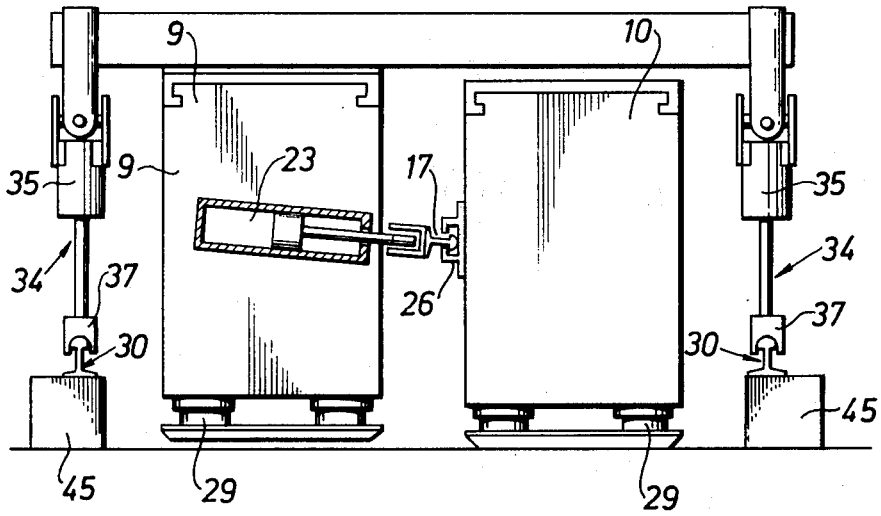
FIGS. 19 and 20 are two rear views of the machine illustrated in FIG. 1 for explaining the operation thereof.
Figure 20:
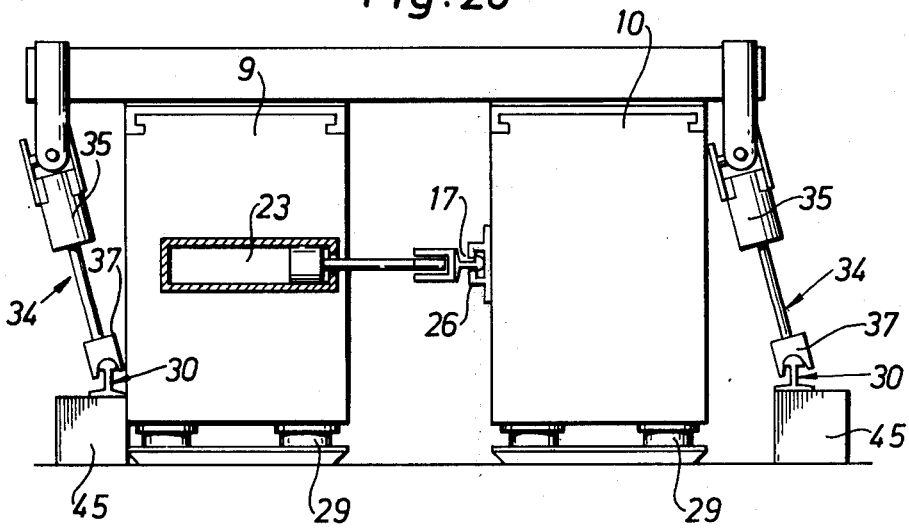
Figure 25:
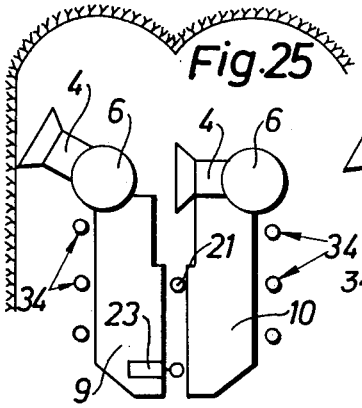
FIGS. 25 to 49 illustrate diagrammatically the successive phases of selective positioning of the half-frames of the machine illustrated in FIG. 1 during a pivoting operation by one-quarter of a turn.

FIG. 19 shows a detail of the subsequent lifting of half frame 9 and FIG. 20 shows a detail of the inclination to the right, the rear of half frame 9 being urged to the left by action of jack 23, which moves half frame 9 relative to half frame 10 which rests on the floor.

Figure 22:
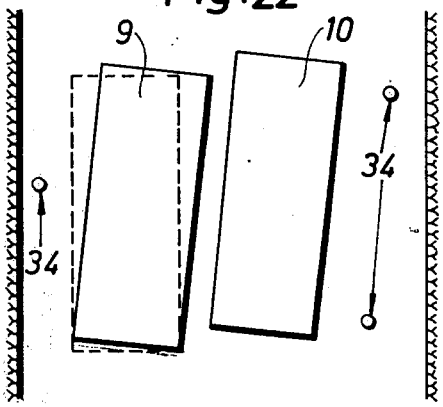

FIG. 22 shows the half-frame 10 anchored, while the left-hand half-frame 9 is released by lifting and turned to the right, as described with reference to FIG. 20.

Figure 23:
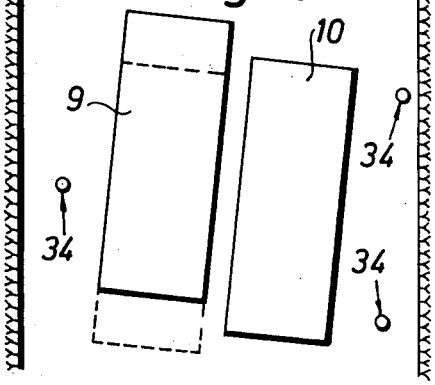

FIG. 23 shows the half-frame 9 subsequently advanced by one step.

Figure 24:
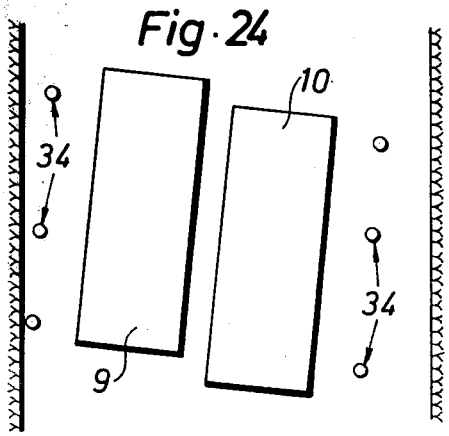

FIG. 24 shows the two half-frames 9, 10 anchored, turned through the same angle and advanced by one step. The machine may then advance in this new direction.

The pivoting of the machine is clearly illustrated in FIGS. 25–49.

Figure 26:
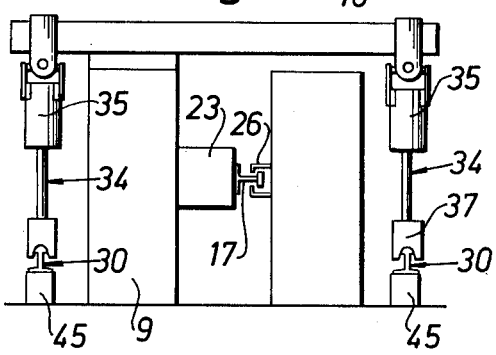

FIG. 26 shows the anchoring rails 30 resting on displaceable caissons.

Figure 27:
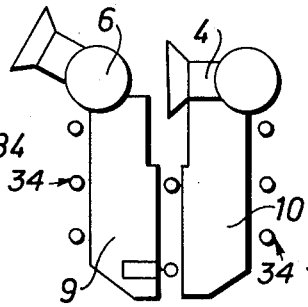

FIG. 27 shows the right-hand half frame 10 raised.

Figure 28:
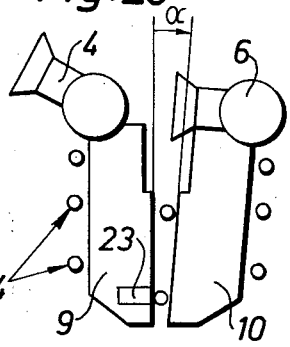

FIG. 28 shows the right-hand frame 10 turned through an angle $\alpha$ by the action of jack 23.

Figure 29:
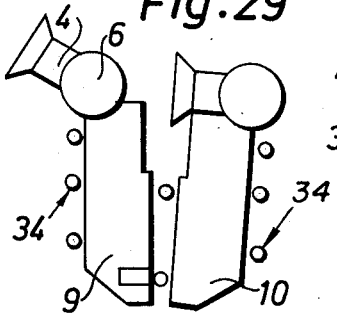

FIG. 29 shows the right-hand half-frame 10 returned to the floor.

Figure 30:
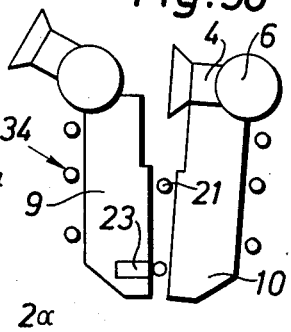

FIG. 30 shows a pivotal lever of the half-frame 10 placed upright again by moving the rail of the foot of the lever.

Figure 31:
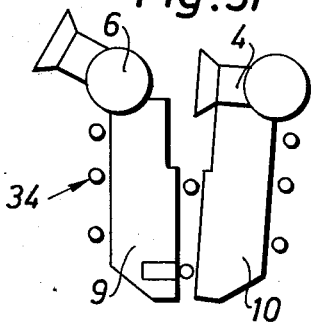
Figure 32:
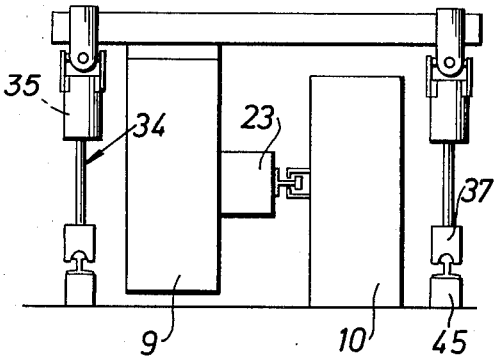

FIGS. 31 and 32 show the left-hand frame 9 raised by the action of anchoring jacks.

Figure 33:
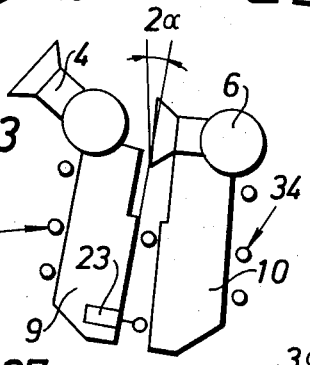
Figure 34:
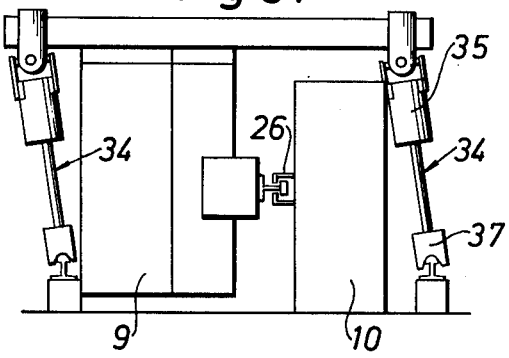

FIGS. 33 and 34 show the left-hand half-frame 9 turned through an angle 2 $\alpha$ relative to the original direction of advance by the action of jack 23.

Figure 35:
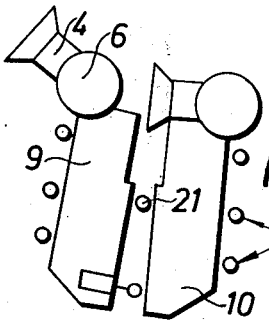
Figure 36:
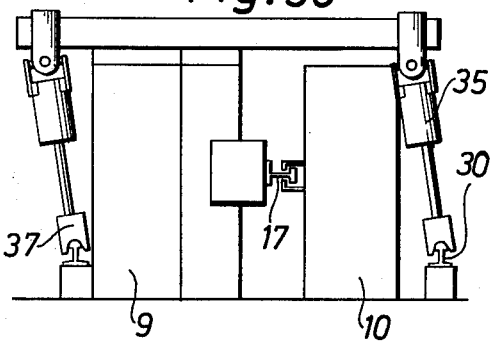

FIGS. 35 and 36 show the left-hand half-frame 9 returned to the floor.

Figure 37:
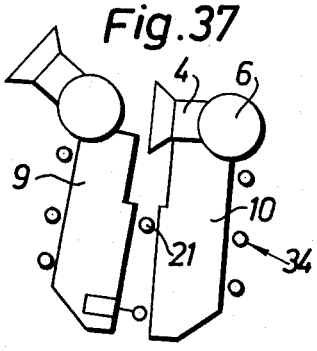
Figure 38:
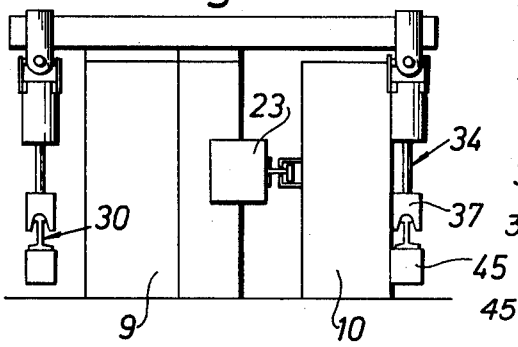
Figure 39:
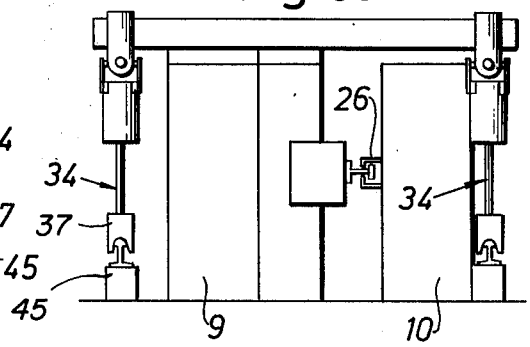

FIGS. 37 to 39 show the pivotal levers of the half-frame 9 returned to the vertical by moving the appropriate rails 30.

Figure 40:
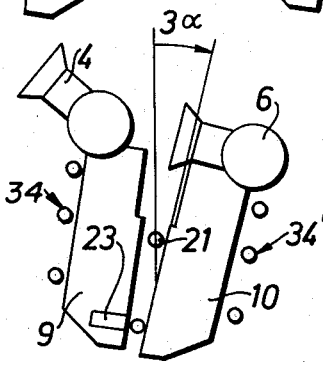

FIG. 40 shows the right-hand half-frame 10 again lifted and turned through an angle of 3 $\alpha$ relative to the original direction of advance by the action of jack 23.

Figure 41:
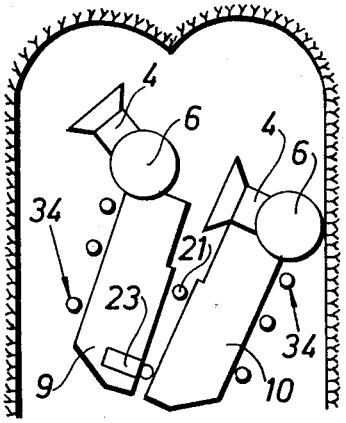

FIG. 41 shows the two half-frames 9, 10 each turned several times through an angle relative to the original direction of advance, the right-hand turret 6 touching the right-hand wall, so that a rearward step must be taken.

Figure 42:
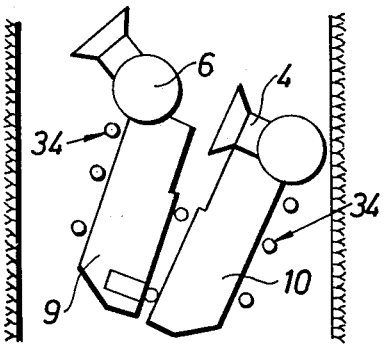

FIG. 42 shows the left-hand half-frame 9 raised.

Figure 43:
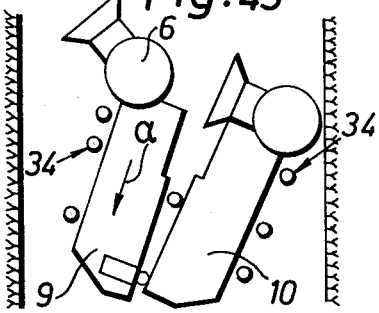

FIG. 43 shows the left-hand half-frame 9 moving back by one step by action of jack 28 on stationary frame 10.

Figure 44:
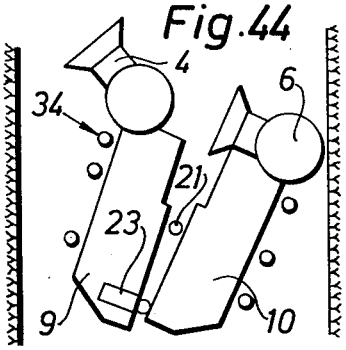

FIG. 44 shows the half-frame 9 returned to the floor.

Figure 45:
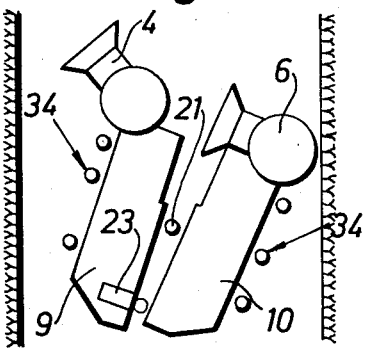

FIG. 45 shows the right-hand half-frame 10 raised.

Figure 46:
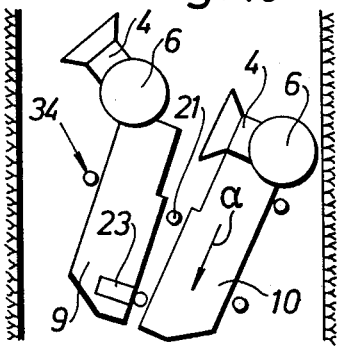

FIG. 46 shows the right-hand half-frame 10 moving back by one step by action of jack 28 on stationary frame 9.

Figure 47:
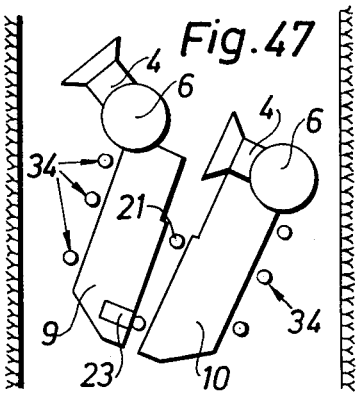

FIG. 47 shows the half-frame 10 returned to the floor.

Figure 48:
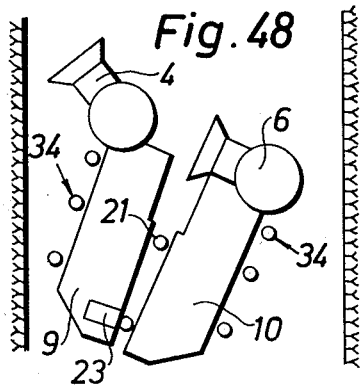

FIG. 48 shows how, after having if necessary moved back by a number of steps, the two half-frames resume pivoting until they are in a position perpendicular to the starting position.

Figure 49:
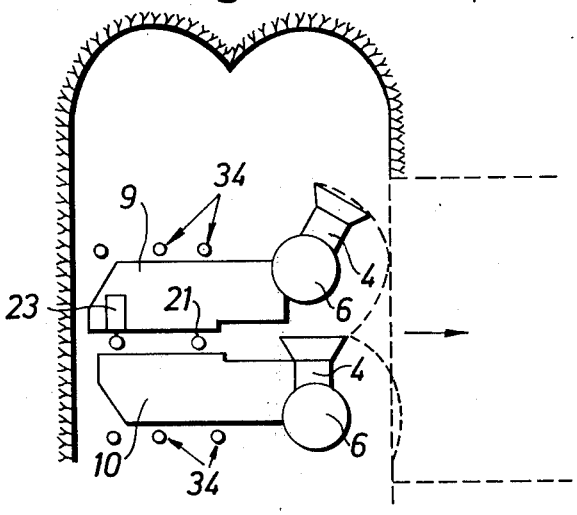
Figure 50:
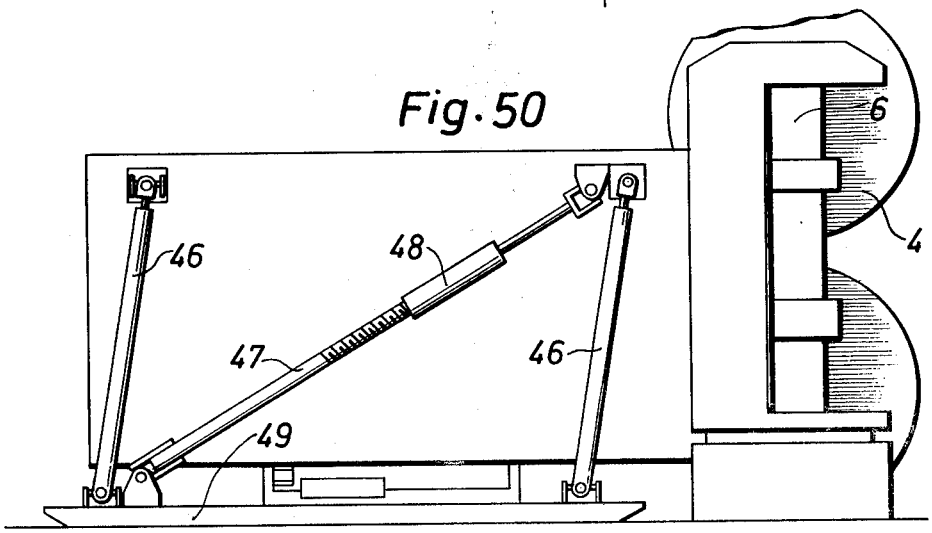
FIG. 50 is a side view of a second embodiment of a machine in accordance with the invention.
Figure 51:
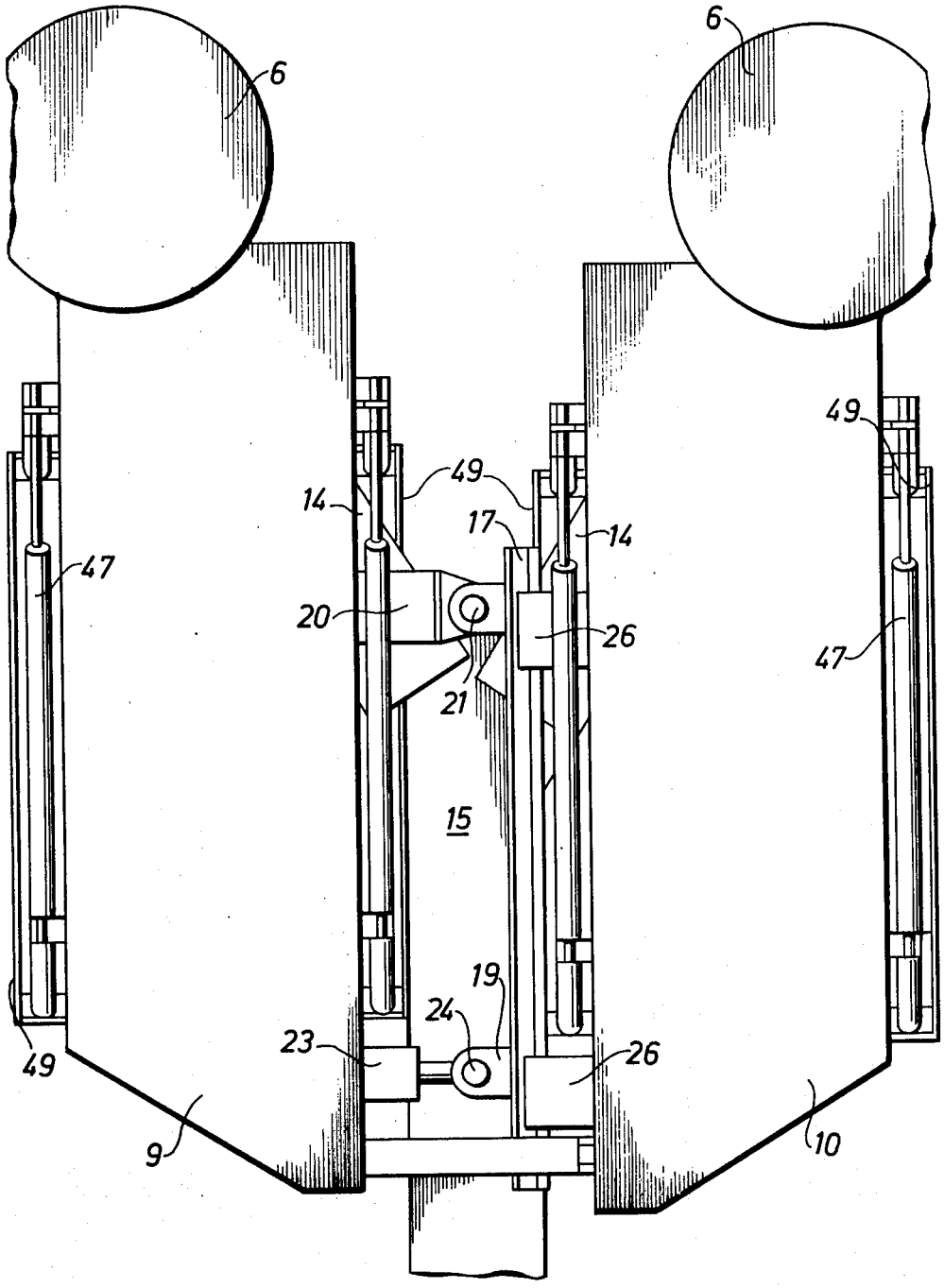
FIG. 51 is a plan view of the machine illustrated in FIG. 50.
Figure 52:
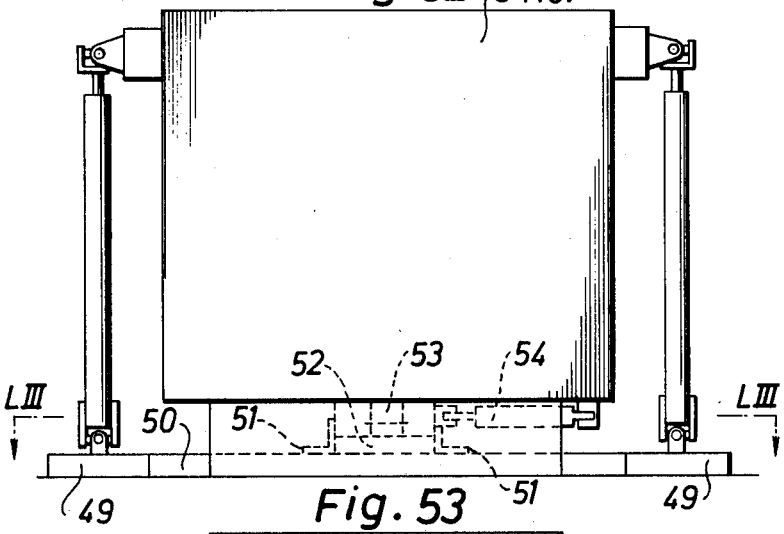
FIG. 52 is a rear view of the machine illustrated in FIG. 50.
Figure 53:
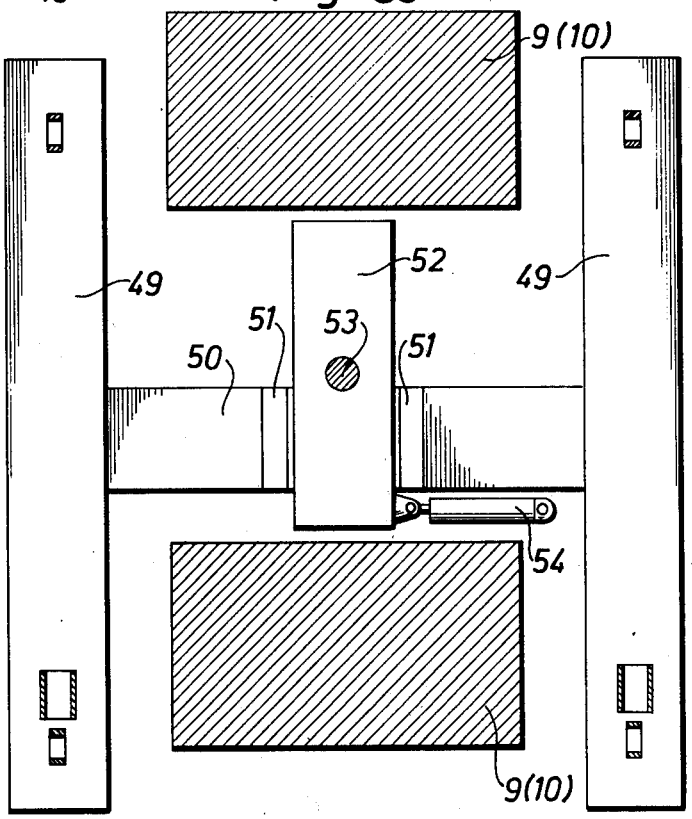
FIG. 53 is a horizontal section, taken along the line L III—L III in FIG. 51 showing the sleepers and their connections in the machine illustrated in FIG. 50.

FIG. 49 shows the machine in its final position ready to from a gallery perpendicular to the first gallery.

The machine can then start on a side gallery to the right of the first gallery.

In a second embodiment of the invention illustrated in FIGS. 50 to 53, the two half-frames 9, 10 each have six jacks 46, 47, there being three jacks on either side of the half-frame. An assembly of three jacks 46, 47 is made up of two parallel jacks 46 and a jack 47 disposed substantially diagonally between the two jacks 46 and having a travel-limiting element 48. The three jacks 46, 47 are connected via toggle joints at their lower ends to a sleeper 49 resting on the floor and by their top ends to the half-frame 9 or 10.

The two sleepers 49 of each half-frame 9, 10 are rigidly connected via a central cross-piece 50 which has two rectangular sectional members 51 defining a transverse groove upstanding thereon, the groove receiving a lever 52. The members 51 are high enough to enable the sleepers 49 or the half-frames 9 or 10 to rise without the lever 52 escaping from the groove. The lever 52 is pivotable around a pivot 53 connected to the half-frame 9 or 10 and is connected at its rear end to a deflecting jack 54 which is pivotally mounted on the half-frame 9 or 10. The pivot 53 is mounted on a slide which is slidable in a groove which is formed in the bottom of the frame or half frame and which is perpendicular to the transverse groove. A transverse adjusting jack is provided which will act on the slide and move the slide in the groove.

As a result, the half-frame 9 or 10 can be displaced relative to the sleepers 49, when the sleepers are in contact with the floor by actuating deflecting jack 54 and the sleepers 49 can be displaced relative to the half-frame 9 or 10, when the half frame is in contact with the floor.

The axial conveyor 15 is disposed between the inner sleepers 49 and the inclined conveyors 14 extend above the inner sleepers 49.

The sleepers 49 are not anchored to the floor, so the second embodiment can be used only when the weight of the machine ensures that it adheres adequately in spite of the longitudinal pressures applied to the sleepers by the excavating work. In this second embodiment the machine may advantageously be ballasted, to extend its use.

Four operations can be performed by the second embodiment having two half frames: a longitudinal traversing movement, deflection, pivoting and a transverse traversing movement.

Longitudinal traversing is clearly illustrated in FIGS. 54 to 60; it is performed step by step by the two half-frames. The description is limited to one set of jacks.

Figure 54:
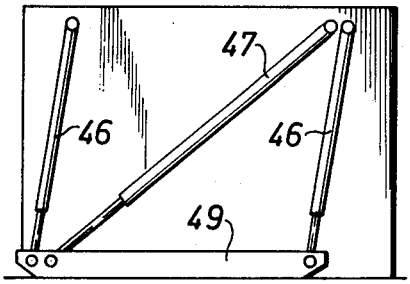
FIGS. 54 to 60 are side views of the machine illustrated in FIG. 50 showing the successive phases of selective modification of the shape of the diagonals forming the parallelograms during a longitudinal advancing operation.

FIG. 54 is a side view of a "parallelogram" formed by jacks 46, 47 and sleeper 49 at the start. The sleeper 49 is resting on the floor in the rear position and the three jacks have their maximum length.

Figure 55:
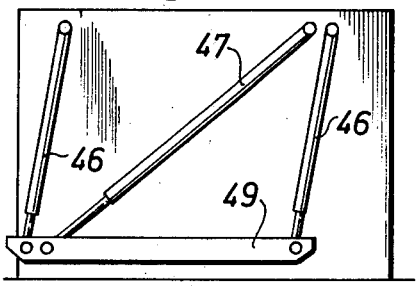

FIG. 55 shows the sleeper 49 lifted by the three jacks 46, 47 which substantially maintain their relative orientation. The two end jacks 45, which are then retracted, are locked at their minimum length.

Figure 56:
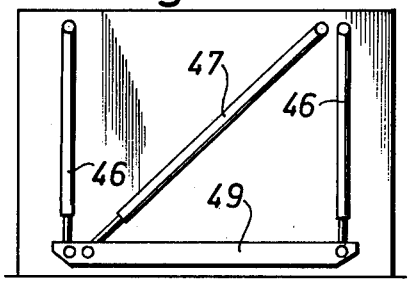

As shown in FIG. 56, the diagonal jack 47 is retracted and advances the sleeper 49 above the floor, making the end jacks 46 pivot around their top point of pivotal support.

Figure 57:
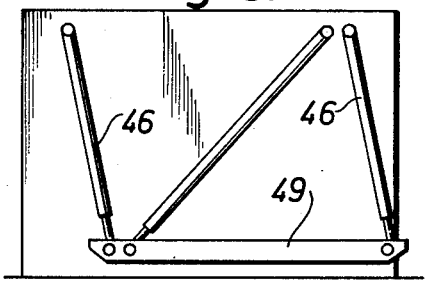

As shown in FIG. 57, the diagonal jack 47 has reached its minimum length and advanced the sleeper 49 to the maximum; while the end jacks 46 cease their pivoting.

Figure 58:
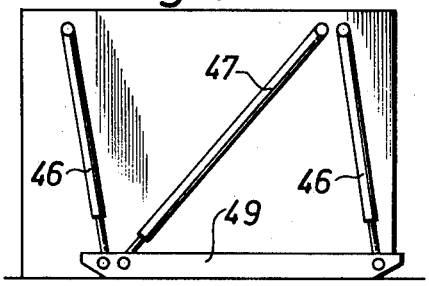

FIG. 58 shows the three end jacks 46 and the diagonal jack 47 stretched out, substantially maintaining their orientation, to apply the sleeper 49 to the floor. The end jacks are at their maximum length again and remain locked at such length.

Figure 59:
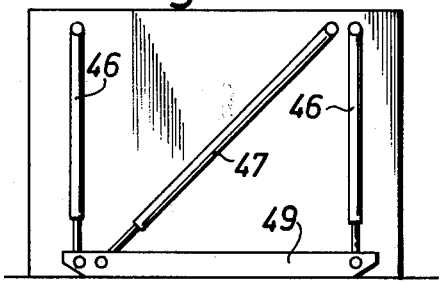

FIG. 59 shows the diagonal jack 47 extended, pivoting the end jacks 46 around their bottom points of pivotal support, and propelling the half-frame 9 or 10, whilst lifting it slightly.

Figure 60:
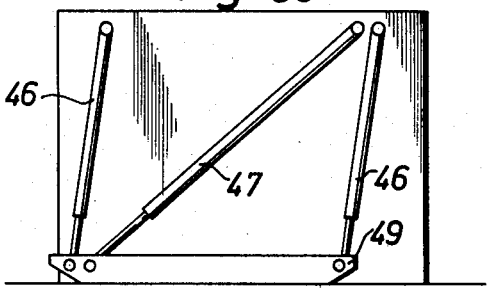

As shown in FIG. 60, the diagonal jack 47 has completed its extension and reached its maximum length. The total advance of one step can be, for instance, 500 mm. The frame 9 and/or 10 and the sleepers are therefore again in the same relative position as at the start.

A frame can be moved backwardly by performing the afore-described operations in reverse order.

The machine may have two half frames, as above described, or may have a single composite frame.

Deflection or the progressive change of direction can be performed in two different ways around the pivot 53, in dependence on whether the machine comprises two half-frames or only one frame.

In the former case the transverse jack 23 is used, procedure being as in the first embodiment of the machine, the pivotal supports of the two ends of the jacks being capable of pivoting in two directions.

In the second-mentioned case, the deflecting jack 54 is actuated when the single frame is lifted by the jacks thus rotating the sleepers relative to the frame. Rotation through an angle of 10° can readily be performed. A rotation can be performed simultaneously with a traversing movement during the lifting of the frame, and a similar expedient may be adopted if two half frames are utilised.

Pivoting around the pivot 53 is produced by a series of successive rotations.

In a further embodiment of the invention the pivotal levers on either side of a frame or half frame may be interconnected by two rods which are rigidly connected to one another by a central cross member, one rod being pivotally connected to a pivotal lever on one side of the frame, and the other rod being pivotally connected to a pivotal lever on the other side of the frame. A jack pivotally connected to the frame can displace the central cross member about a central position. When the frame is resting on the floor and the pivotal levers are retracted the rods may operate to move the levers towards or away from the sides of the frame, thus permitting the frame to be traversed sideways.

I claim:

1. A machine for excavating an underground gallery, comprising a frame structure consisting essentially of two half-frames vertically arranged side by side, means for supporting each half-frame on the gallery floor independent of the other half-frame, two parallel vertical shafts respectively supported by said two half-frames, a separate turret pivotally supported around each of said shafts, each of said turrets having a cutting head which can rotate around a horizontal axis and which is equipped with tools for excavating, said two half-frames being movable horizontally in relation to one another, a control member connected between said half-frames for controlling said relative movement, the two half-frames being selectively and independently positionable on the gallery floor by said relative movement, one half-frame being movable while the other half-frame remains fixed in position.

2. A machine according to claim 1, further comprising an assembly of pivotal levers pivotally connected to the half-frames and distributed on each side of each half frame, each pivot lever having a jack acting on jaws and cooperating with anchoring rails.

3. A machine according to claim 2 wherein the pivotal levers are interconnected by two rods rigidly connected to one another by a central cross-member, a jack pivotally connected to the half-frame, said jack being connected to said cross-member and being operable to displace said cross-member on either side of a central position.

4. A machine according to claim 2 wherein the anchoring rails are secured to anchoring rods, the anchoring rods being set in the floor, so that the half frames are selectively anchorable on the gallery floor.

5. A machine according to claim 2, wherein two rows of anchoring rods are provided, one row of rods being set in the floor on either side of the machine.

6. A machine according to claim 2, wherein one half-frame includes a pivotal lever which is disposed adjacent the side of the other half-frame which is remote from the said one half frame, said pivotal lever being suspended from a beam attached to the first half-frame and crossing the second half-frame without contact therewith, so as to cooperate with the same anchoring rail as pivotal levers associated with the second half-frame.

7. A machine according to claim 2 wherein said pivotal levers each comprise a rod having a lifting jack.

8. A machine according to claim 7 wherein the rod of each pivotal lever rests on one of said rails extending along the floor during the lifting of the frame or half-frames.

9. A machine according to claim 8 wherein the bottom of the rod of each pivotal lever has jaws enclosing a flange of said rail on which it rests, so as to act selectively as means for lifting the frame by the pressure being exerted downwards on to the flange of the rail by pivotal lever rod, and as means for anchoring the frame by the pivotal lever rod pulling upwards to engage the jaws with the flange, the rail being anchored to the floor.

10. A machine according to claim 7, wherein the rod of each pivotal lever rests on a rail mounted on an auxiliary support which bears against the floor without being anchored thereto, the bottom of the rod having jaws for bearing against and gripping a flange of the rail.

11. A machine according to claim 1 wherein means are provided for guiding the half frames relative to each other, said guiding means comprising at least one longitudinal rail fixedly connected to one-half frame along which two slides connected to the other half-frames slide.

12. A machine according to claim 1 wherein the half-frames are pivotally connected to one another and angularly adjustable with respect to each other.

13. A machine according to claim 12 wherein the two half-frames are pivotally connected by a universal joint pivot.

14. A machine according to claim 13, wherein the universal joint pivot slides vertically in relation to one of the two half-frames.

15. A machine according to claim 14, wherein the two half-frames are angularly adjustable by the action of a transversely pivoting jack.

16. A machine according to claim 13, wherein the two half-frames pivot individually around a vertical pivot of the universal joint.

17. A machine according to claim 1 comprising at least one semi-annular collecting tank for collecting cutting spoil, the collecting tank being swept by a scraper which propels the collected spoil over an inclined ramp terminating at a central evacuating conveyor.

18. A machine according to claim 17 wherein the outer end of the collecting tank has a fixed semi-cylindrical tumbler which moves the cutting spoil above the scraper.

19. A machine for excavating an underground gallery, comprising a frame structure consisting essentially of two half-frames vertically arranged side by side, two parallel vertical shafts respectively supported by said two half-frames, a separate turret pivotally supported around each of said shafts, each of said turrets having a cutting head which can rotate around a horizontal axis and which is equipped with tools for excavating, each half-frame having pivotal levers by which it can first be disengaged from the floor and lifted, and then displaced in the gallery by the simultaneous inclination of the pivotal levers and finally replaced on the floor in a fresh position, each half-frame being thus displaceable to said fresh position independent of the other half-frame.

20. A machine according to claim 19 wherein the pivotal levers have lifting jacks adapted to lift the sleepers and half frames alternately.

21. A machine according to claim 19, comprising at least one semi-annular collecting tank for collecting cutting spoil, the collecting tank being swept by a scraper which propels the collected spoil over an inclined ramp terminating at a central evacuating conveyor.

22. A machine according to claim 21 wherein the outer end of the collecting tank has a fixed semi-cylindrical tumbler which moves the cutting spoil above the scraper.

23. A machine according to claim 19 wherein the pivotal levers are interconnected by two rods rigidly connected to one another by a central cross-member, a jack pivotally connected to the half-frame, said jack being connected to said cross-member and being operable to displace said cross-member on either side of a central position.

24. A machine for excavating an underground gallery, comprising a frame structure consisting essentially of two half-frames vertically arranged side by side, two parallel vertical shafts respectively supported by said two half-frames, a separate turret pivotally supported around each of said shafts, each of said turrets having a cutting head which can rotate around a horizontal axis and which is equipped with tools for excavating, each half-frame having pivotal levers which are pivoted in two directions, said levers being interconnected at the bottom by two longitudinal sleepers which can rest on the floor and by means of which the half-frame can first be disengaged from the floor and lifted, then displaced in the gallery by the simultaneous inclination of the pivotal levers, and finally replaced on the floor in a fresh position, each half-frame being thus displaceable to said fresh position independent of the other half-frame.

25. A machine according to claim 24, wherein the sleepers are rigidly connected by a central cross-piece whose centre is formed with a transverse groove parallel with the sleepers and receiving a lever which is pivotally connected to the half frame, a deflecting jack pivotally connected to said half-frame and operable to rotate said lever around the pivotal connection.

26. A machine according to claim 25, wherein the bottom of the half frame is formed with a groove perpendicular to the transverse groove, and a slide sliding in the first-mentioned groove bears the said pivotal connection between the half frame and the lever.

27. A machine according to claim 26 wherein the said pivotal connection between the half frame and the lever can be displaced by a jack acting on the slide.

28. A machine for excavating an underground gallery, comprising a frame structure consisting essentially of two half-frames vertically arranged side by side, two parallel vertical shafts respectively supported by said two half-frames, a separate turret pivotally supported around each of said shafts, each of said turrets having a cutting head which can rotate around a horizontal axis and is equipped with tools for excavating, each half-frame including two pivotal levers pivotal in two directions on either side of the half-frame, a separate sleeper associated with the two levers on each side of said half-frame, the associated levers being pivotally connected at the ends thereof to said sleeper to form an articulated parallelogram in which the sleeper forms the base and the two pivotal levers form inclined sides, a control jack disposed substantially along a diagonal of the parallelogram controlling the deformation thereof, each half-frame being selectively displaceable independent of the other half-frame in response to the deformation of the associated parallelograms.

29. A machine for excavating an underground gallery, comprising a frame structure consisting essentially of two half-frames vertically arranged side by side, two parallel vertical shafts respectively supported by said two half-frames, a separate turret pivotally supported around each of said shafts, each of said turrets having a cutting head rotating around a horizontal shaft and having tools for excavating, each half-frame including two pivotal levers pivotal in two directions on either side of the half-frame, a separate sleeper associated with the two levers on each side of said half-frame, the associated levers being pivotally connected at the ends thereof to said sleeper to form an articulated parallelogram in which the sleeper forms the base and the two pivotal levers the inclined sides, a longitudinal jack connected between the half-frame and the sleeper to displace the half-frame longitudinally by articulated movement of said parallelogram for selective movement of each half-frame independent of the other half-frame.

* * * * *